United States Patent [19]

Grable

[11] Patent Number: 4,499,448

[45] Date of Patent: Feb. 12, 1985

[54] ELECTRIC CIRCUIT INTERRUPTER

[76] Inventor: Jack W. Grable, 7010 Malabar Ct., Dayton, Ohio 45459

[21] Appl. No.: 467,587

[22] Filed: Feb. 18, 1983

[51] Int. Cl.[3] ..... H01H 37/52

[52] U.S. Cl. ..... 337/370; 337/333; 29/622

[58] Field of Search ..... 337/333, 354, 370, 371, 337/407, 415, 157; 361/103, 105; 29/622, 623

[56] References Cited

U.S. PATENT DOCUMENTS 3,715,697 2/1973 Them ..... 337/333

4,237,513 12/1980 Foldes ..... 337/415

4,339,740 7/1982 Greenhalgh ..... 337/370

4,352,082 9/1982 Barry et al. ..... 337/407

*Primary Examiner*—Harold Broome

*Attorney, Agent, or Firm*—Jacox & Meckstroth

[57] ABSTRACT

An electric circuit interrupter device in which an electric circuit extends through the device. Within the device is a frangible link in the electric circuit. A plunger is engageable with the link. A stack of thermally responsive discs is expandable in length to force the plunger against the link to break the link and to interrupt the electric circuit.

6 Claims, 16 Drawing Figures

ELECTRIC CIRCUIT INTERRUPTER

BACKGROUND OF THE INVENTION

Numerous types of electrical appliances, motors, devices, and instruments require means for deenergization thereof when the temperature thereof exceeds a predetermined magnitude.

Electric circuit interrupters of several types have been devised. However, each type of such device has disadvantages, such as relatively high cost, lack of accuracy, lack of dependability, limited operating temperatures, etc.

It is an object of this invention to provide an electric circuit interrupter device which may be produced at relatively low costs, is highly dependable and accurate in operation, and which is capable of operating at relatively high temperatures.

Another object of this invention is to provide an electric circuit interrupter device which can be readily calibrated for operation at a desired temperature.

Another object of this invention is to provide such an electric circuit interrupter device which can be calibrated at the time of production, or in which an uncalibrated device can be placed into storage and calibrated later.

Another object of this invention is to provide such an electric circuit interrupter device which can be calibrated to operate at any temperature within a given range of temperatures.

Other objects and advantages of this invention reside in the construction of parts, the combination thereof, the method of production, and the mode of operation, as will become more apparent from the following description.

SUMMARY OF THE INVENTION

An electric circuit interrupter device of this invention comprises a housing through which an electric circuit extends. Included in the electric circuit is a frangible link. A thrust member within the housing has a portion adjacent the frangible link. One or more thermally responsive bimetallic discs are within the housing and are changeable in physical shape. When the interrupter device is subjected to a temperature in excess of a predetermined magnitude, the bimetallic discs change in shape and force the thrust member against the frangible link, causing the frangible link to break. Thus, the electric circuit is interrupted.

DETAILED DESCRIPTION OF THE INVENTION

FIGS. 1-5

Figure 1:
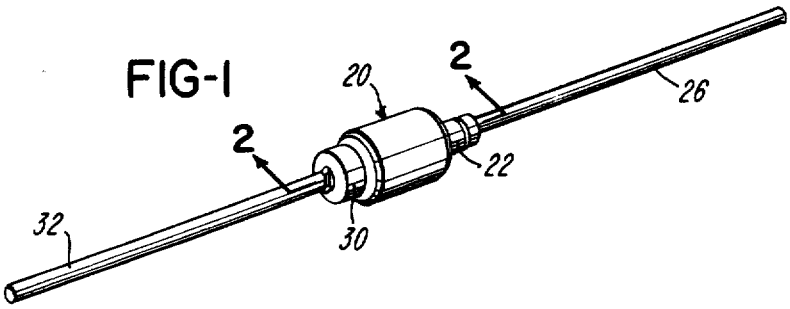
FIG. 1 is a perspective view of an electric circuit interrupter device of this invention.

An electric circuit interrupter device of this invention, as shown in FIGS. 1-5, comprises a generally tubular housing member 20, provided with a reduced end portion 22 which is crimped, or otherwise secured to an electric conductor lead 26, which extends into the housing 20. The housing 20 is of any suitable electrically conductive material.

A bushing 30, at the other end of the housing 20, has a portion within the housing 20 and secured thereto by a bent portion **20*a* of the housing 20. The bushing 30 is of an electrically non-conductive material of any suitable type. An electric conductor lead 32 extends through the bushing 30 and into the housing 20. A bulge 34 in the lead 32 determines the length position of the lead 32 within the bushing 30**.

Figure 2:
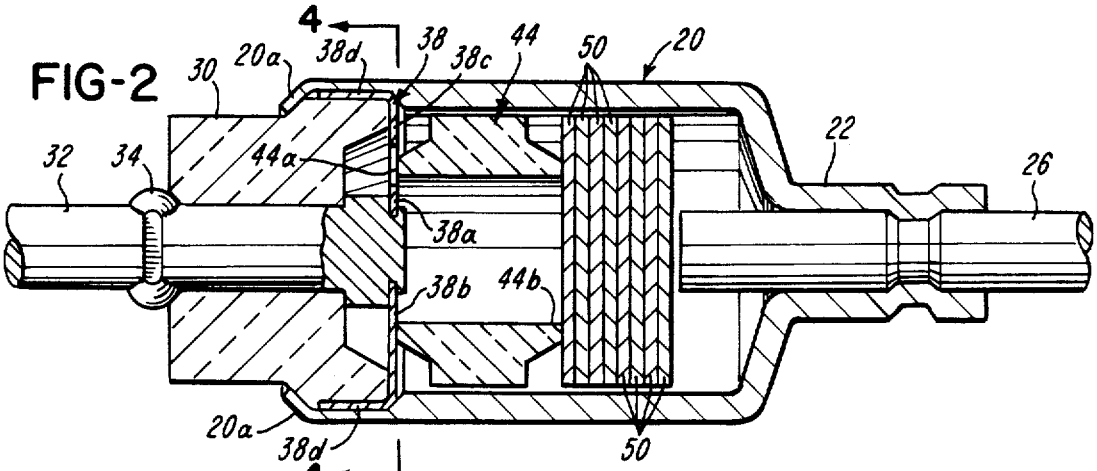
FIG. 2 is a greatly enlarged section view taken substantially on line 2—2 of FIG. 1.
Figure 5:
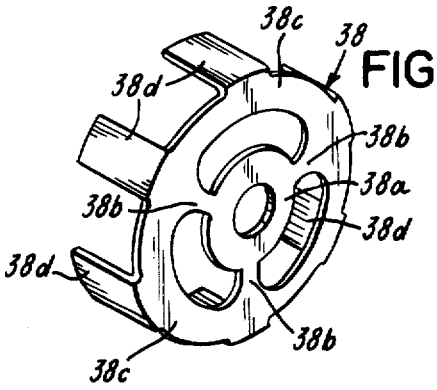
FIG. 5 is a perspective view of a connector member of a device of this invention.
Figure 6:
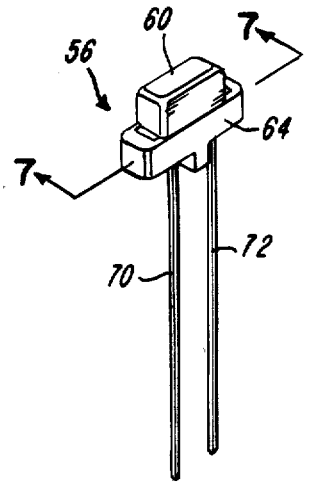
FIG. 6 is a perspective view, drawn on substantially the same scale as FIG. 1, showing another embodiment of the electric circuit interrupter device of this invention.

Within the housing 20 is an electrically conductive connector member 38, best shown in FIG. 5. The connector member 38 has a central annular portion **38*a* which is attached to the lead 32, as best shown in FIG. 2. A plurality of link portions 38*b* join the central annular portion 38*a* to an outer annular portion 38*c*. Joined to the outer annular portion 38*c* and extending angularly therefrom are leg portions 38*d*, which are tightly sandwiched between the housing 20 and the bushing 30** and in firm engagement therewith.

Also within the housing 20 is a plunger 44, shown herein as being generally cylindrical. The plunger 44 has an end portion **44*a* in engagement with the link portions 38*b* of the connector member 38. The plunger 44 has an opposite end portion 44*b* in engagement with a disc 50, in a stack of discs 50. The stack of discs 50 is shown positioned between the end portion 44*b* of the plunger 44 and the electric conductor lead 26. The discs 50 are thermally responsive, as each of the discs 50 comprises at least two integral layers or the like, in which the layers are of different materials. One layer is of a material which has a high coefficient of thermal expansion, and another layer is of a material which has a low coefficient of thermal expansion. For example, the discs 50** may be bimetallic, in which one layer is of a metal, such as Invar, having a low coefficient of thermal expansion and another layer is of a metal having a high coefficient of thermal expansion.

The device of FIGS. 1-5 may be calibrated at the time of production or at the time the device is placed into use. Calibration is performed by retaining the device at a temperature slightly below the desired operating temperature. While maintaining the device at such temperature, the electric conductor lead 26 is moved into the housing 20 until the lead 26 applies a predetermined force upon the end disc 50 in the stack thereof. This force is applied to the stack of discs 50 as an initial pre-load force which is presented toward movement of the plunger 44. Therefore, when the desired operation temperature occurs the force necessary to break the links 38*a* will have been generated in the stack of discs 50. As this pre-load force is maintained, the reduced end portion 22 is crimped, as illustrated, to maintain the position of the lead 26 with respect to the housing 20 and to maintain the pre-load force upon the stack of discs 50.

OPERATION

The device of FIGS. 1-5 is adapted to conduct electric current between the electric conductor leads 26 and 32, as an electric circuit extends from the conductor lead 26 through the housing 20, through the legs 38*d* of the connector member 38, through the outer annular portion 38*c*, through the link portions 38*b*, through the central portion 38*a*, and to the conductor lead 32.

Figure 3:
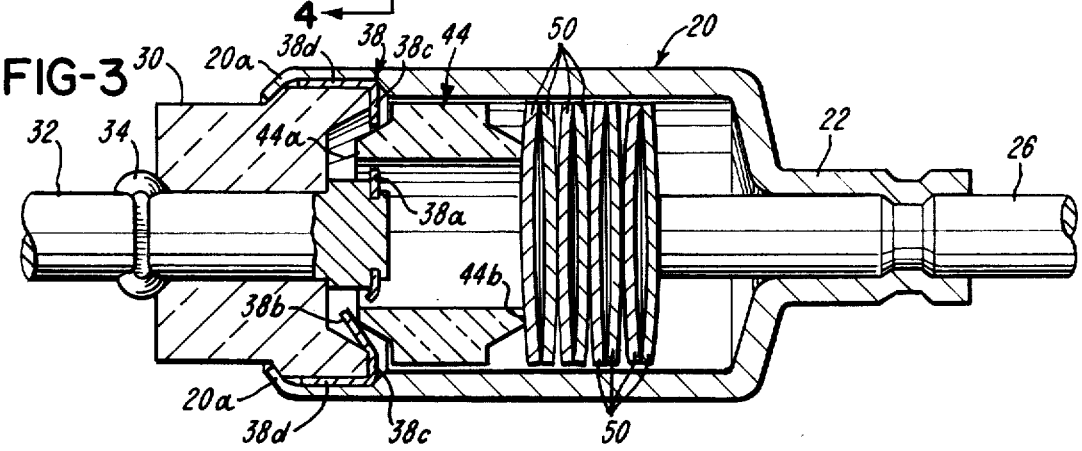
FIG. 3 is a section view similar to FIG. 2 and illustrating the elements of the device after circuit interruption.
Figure 4:
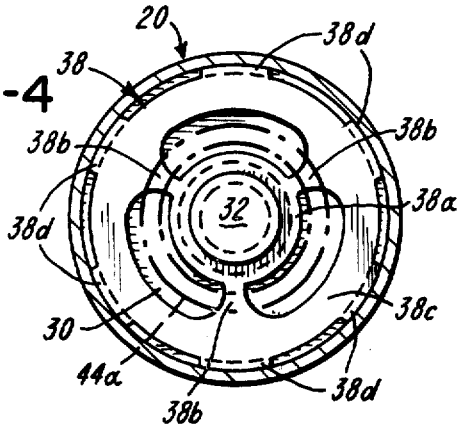
FIG. 4 is a section view taken substantially on line 4—4 of FIG. 2.

The electric circuit interrupter device is adapted to be mounted in an electrically operated appliance or motor or instrument or the like. If the appliance or instrument becomes excessively heated, the temperature of the electric circuit interrupter device rises above a predetermined magnitude. As the temperature of the device increases, the thermally responsive discs 50 change in shape from that illustrated in FIG. 2 to the shape illustrated in FIG. 3. As shown in FIG. 3, the thermally responsive discs 50 are arranged in the stack thereof in opposite orientation so that when the discs 50 change in shape, adjacent discs 50 curve away from each other. When this curvature occurs, the stack of discs 50 expands in length and applies a significant pressure upon the plunger 44. When the desired operating temperature is reached, the length of the stack of discs 50 is such that the plunger 44 is forced toward the connector member 38. When this occurs, the links 38*b* of the connector member 38 are broken, as illustrated in FIG. 3. When these links 38*b* are broken, the electric circuit between the conductor lead 26 and the conductor lead 32 is broken and interrupted, and the current flow therebetween is interrupted.

FIGS. 6-10

FIGS. 6-10 show another embodiment of the current interrupter device of this invention. The device of FIGS. 6-10 comprises a housing 56, which includes a cup-shape housing member 60 and a relatively flat housing member 64. The cup-shape housing member 60 may be of electrically conductive or electrically non-conductive material. The flat housing member 64 is of electrically non-conductive material. The flat housing member 60 has a channel 66 at opposite ends thereof into which a portion of the cup-shape housing is positioned.

An electric conductor lead 70 and an electric conductor lead 72 extend into the housing 56 through the housing member 64, and are attached to an electrically conductive connector member 76. Thus, an electric circuit is established from the conductor lead 70 through the connector member 76 and to the conductor lead 72. Between the conductor leads 70 and 72 the connector member 76 has a link portion 76*a*. Shown in FIGS. 7-10 immediately below the link portion 76*a*, the housing member 64 has a recess 80. Within the housing portion 60 is a plunger 84 having a tapered end portion 84*a*, which is in engagement with the link portion 76*a* of the connector member 76. Shown immediately above the plunger 84 is a stack of thermally responsive discs 86. The uppermost disc 86 engages a wall portion 60*a* within the housing member 60.

Figure 7:
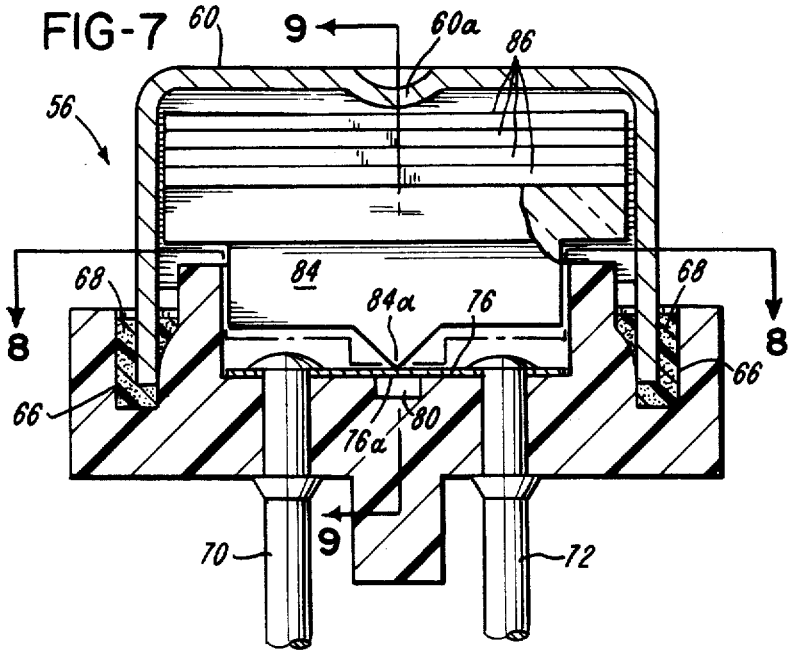
FIG. 7 is a greatly enlarged section view taken substantially on line 7—7 of FIG. 6.
Figure 10:
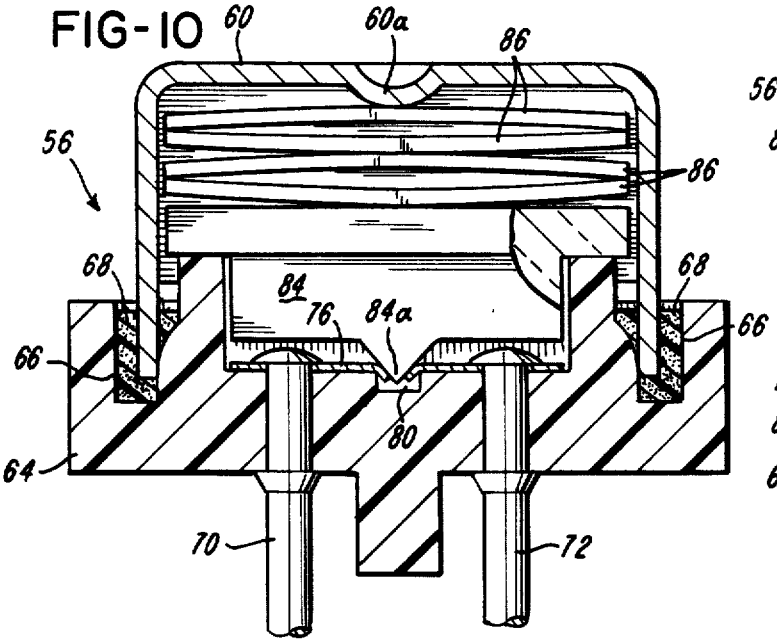
FIG. 10 is a section view similar to FIG. 7, illustrating the conditions within the device following electric circuit interruption.
Figure 9:
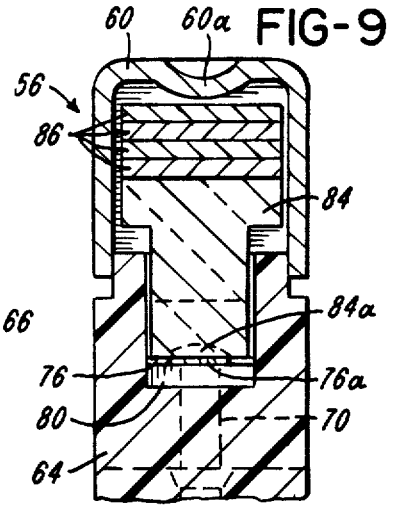
FIG. 9 is a section view, taken substantially on line 9—9 of FIG. 7.
Figure 8:
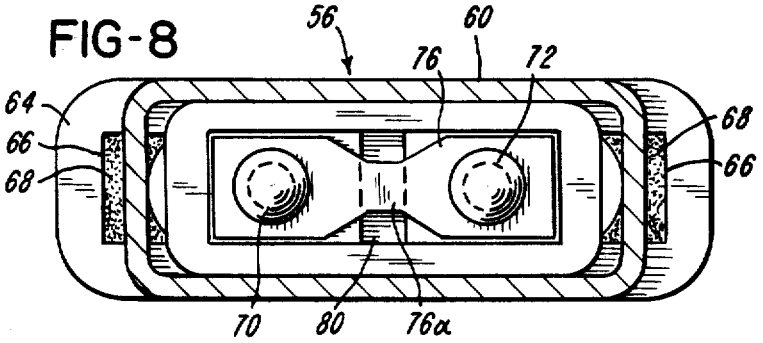
FIG. 8 is a section view taken substantially on line 8—8 of FIG. 7.
Figure 12:
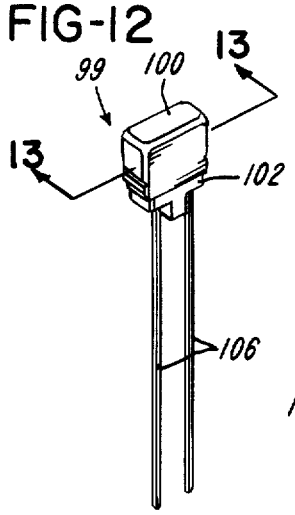
FIG. 12 is a perspective view of another embodiment of an electric circuit interrupter device of this invention, drawn substantially on the same scale as FIGS. 1 and 7.

In attaching the cup-shape housing member 60 to the flat housing member 64, material 68 is introduced into the channels 66 in a liquid state and permitted to solidify, as illustrated in FIGS. 7, 8 and 10. The material 68 may be of the epoxy type, or solder type, or the like, or any other suitable material which readily flows into the channels 66 as a liquid and which is a solid at elevated temperatures to secure the housing member 60 and 64 together.

As the device of FIGS. 6-10 is subjected to increasing temperatures, the thermally responsive discs 86 in the stack thereof change from a relatively flat shape, as shown in FIG. 7, to a curved shape, as shown in FIG. 10. The discs 86 are arranged in the stack thereof so that when the discs 86 change in shape, adjacent discs 86 curve away from each other. Thus, the stack of discs 86 increases in total length dimension, and when a predetermined temperature is reached, the stack of discs 86 reaches a predetermined length. When this occurs the plunger 84 is forced toward the connector member 76, and the tapered portion 84*a* of the plunger 84 breaks the link 76*a*, as the link 76*a* is forced into the recess 80. Thus, the electric circuit through the connector member 76 is broken, and the electric circuit between the conductor leads 70 and 72 is interrupted.

FIG. 11

Figure 11:
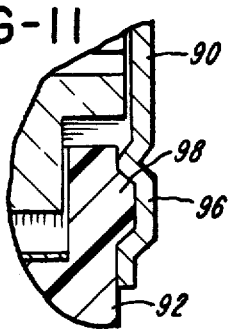
FIG. 11 is a fragmentary section view illustrating a modification in the attachment of housing members of this embodiment.

FIG. 11 shows a modification in the attachment of a cup-shape housing member 90 to a relatively flat housing member 92 in an electric circuit interrupter device of this invention. A portion 96 of the cup-shape housing member 90 is clamped or crimped, or bent upon a portion 98 of the flat housing member 92 to secure the housing member 90 to the housing member 92. This attachment procedure may be performed as a part of the calibration procedure when the device is maintained at a desired temperature.

FIGS. 12-15

FIGS. 12-15 show another embodiment of an electric current interrupter of this invention. A housing 99 comprises a housing member 100 and a housing member 102 which are attached together by any suitable means such as by clamping portions 100*a* and 102*a*, in a manner disclosed and discussed with respect to the modification of FIG. 11. A continuous electric conductor member 106 extends through the housing member 102 and has a link portion 106*a*. Shown immediately above the link portion 106 is a plunger 110. The plunger 110 has a tapered portion 110*a* which is in engagement with the link portion 106*a* of the conductor 106.

Shown above the plunger 110 in FIGS. 13 and 15 is a stack of thermally responsive discs 120. The uppermost disc 120 is in engagement with a part 100*b* of the housing portion 100.

The electric conductor lead 106 constitutes an electric circuit which extends through the device shown in FIGS. 12–15. As the device is subjected to increasing temperatures the thermally responsive discs 120 change from a substantially flat shape shown in FIG. 13 to a curved shape shown in FIG. 15. When the temperature reaches a predetermined magnitude the total length dimension of the stack of discs 120 is a predetermined length and the plunger 110 is forced toward the conductor 106. The tapered portion 110*a* of the plunger 110 breaks the link portion 106*a* of the conductor 106. Thus, the conductor 106 is severed into two portions and the electric circuit through the conductor 106 is interrupted.

FIG. 16

Figure 16:
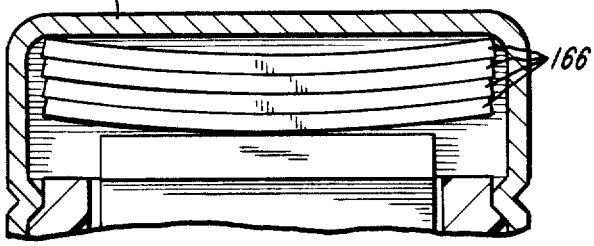
FIG. 16 is a fragmentary section view illustrating a modification in a portion of the device of FIGS. 12-15 and illustrating conditions following current interruption.
Figure 13:
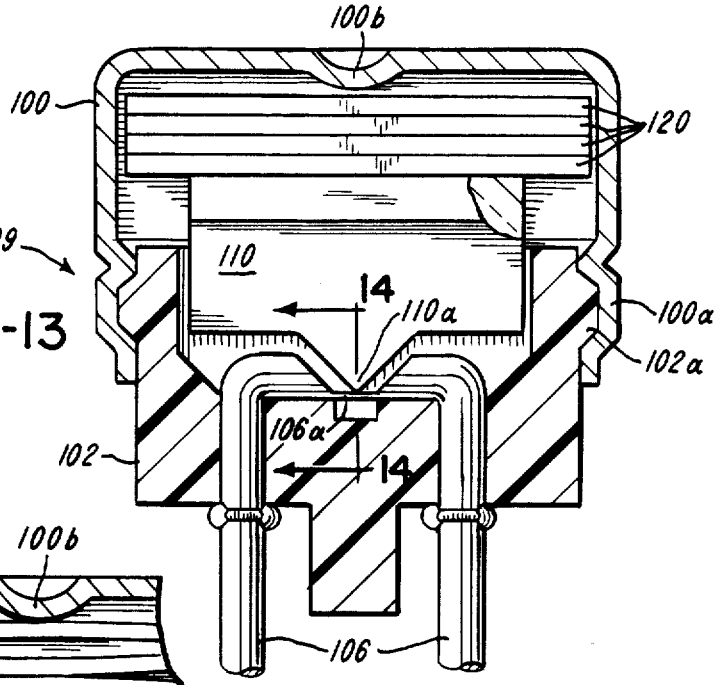
FIG. 13 is a greatly enlarged section view taken substantially on line 13—13 of FIG. 12.
Figure 15:
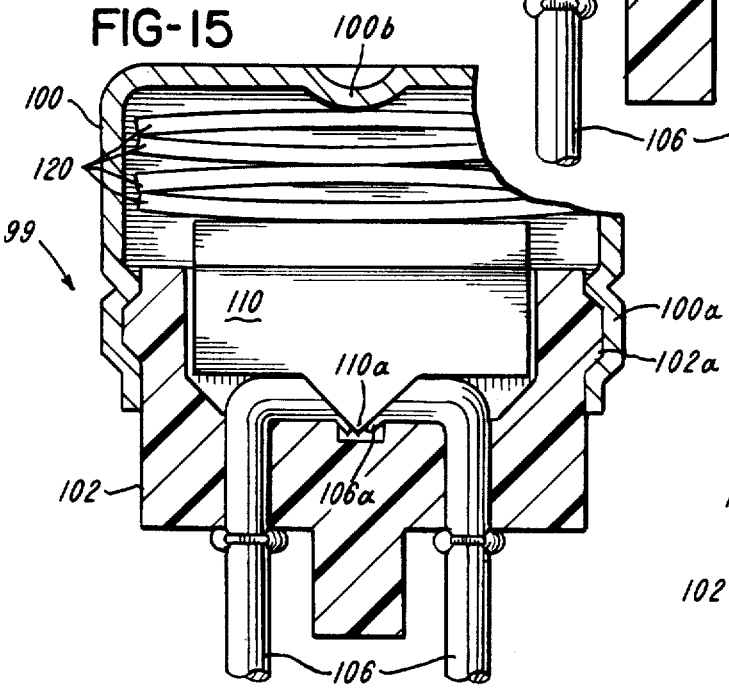
FIG. 15 is a fragmentary section view showing a portion of the structure of FIG. 13 following electric circuit interruption.
Figure 14:
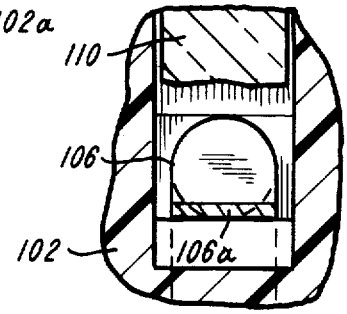
FIG. 14 is a section view taken substantially on line 14—14 of FIG. 13.

FIG. 16 shows a housing 160 of a current interrupter device of this invention. Within the housing 160 is a stack of thermally responsive discs 166, which, when subjected to a temperature above a given magnitude, change from a flat shape to a curved shape, as shown in FIG. 16. The discs 166 are so arranged that upon expansion, all of the discs 166 curve in the same direction to move a plunger or the like to interrupt an electric circuit. This arrangement of discs may be employed in any device of this invention, regardless of the type of housing or other structural features. This arrangement of the discs provides means for generating greater force levels per increment of temperature change than is possible in a disc arrangement having discs which curve in opposite directions.

It is also to be understood that an electric circuit interrupter device of this invention may include a stack of thermally responsive discs in which some adjacent discs curve in opposite directions, while some adjacent discs curve in the same direction.

It is also to be understood that the housing members referred to above and shown in the drawings may be considered as enclosure means.

SUMMARY

An electric circuit interrupter device of this invention serves as means through which an electric circuit extends and also serves as means for interruption of the electric circuit upon subjection to a temperature above a predetermined magnitude.

Although the preferred embodiment of the electric circuit interrupter of this invention has been described, it will be understood that within the purview of this invention various changes may be made in the form, details, proportion and arrangement of parts, the combination thereof, and the mode of operation, which generally stated consist in a structure within the scope of the appended claims.

The invention having thus been described, the following is claimed:

1. The method of producing an electric circuit interrupter device comprising producing a cup-shape housing member and producing a relatively flat housing member provided with a recess therein, placing within the cup-shape housing member a stack of thermally responsive disc members which change in total stack length upon subjection to changes in temperature, extending electric conductor means through the relatively flat housing member, positioning within the cup-shape housing member a thruster member which is engageable with the conductor means to sever a portion of the conductor means, positioning a portion of the cup-shape housing member within the recess of the relatively flat housing member while maintaining the housing members at a given temperature, relatively moving the housing members to positions in which the stack of disc members engages the thruster member and the thruster member engages the electric conductor means, placing within the channel a material in a fluid state which solidifies and retains the relative positions of the housing members.

2. The method of producing an electric circuit interrupter device which includes positioning a stack of thermally responsive disc elements within enclosure means and positioning electric conductor means within the enclosure means, the disc elements being of the type which changes in physical shape to change the total stack length upon subjection of the stack to increasing temperatures, positioning thruster means within the enclosure means and between the stack of discs and the electric conductor means, urging the stack of discs toward the thruster member and urging the thruster member toward the electric conductor means while maintaining the disc elements at a given temperature, providing means to maintain the relative positions of the stack of disc elements and the thruster member within the enclosure means, the stack of disc elements expanding in length as the temperature to which the stack is subjected increases and the stack of disc elements forcing the thruster means to sever the electric conductor means when the stack of disc elements is subjected to a predetermined temperature.

3. An electric circuit interrupter device comprising:

a housing, electric circuit means extending through the housing, the electric circuit means including frangible link means within the housing, plunger means engageable with the frangible link means, thermally responsive disc means changeable in physical shape in response to a temperature change to move the plunger means to break the frangible link means to interrupt the electric circuit means, the housing including a cup-shape housing portion and a relatively flat housing portion, the relatively flat housing portion having a recess therein, a part of the cup-shape housing portion being positioned in the recess of the relatively flat housing portion, fastening means within the recess and retaining the position of the cup-shape housing portion with respect to the relatively flat housing portion, the fastening means being a material which is changeable from a liquid state to a solid state and which is introduced into the recess in a liquid state and which solidifies in the recess to retain the cup-shape housing portion with respect to the relatively flat housing portion.

4. An electric circuit interrupter device comprising:

a housing, electric circuit means extending through the housing, the electric circuit means including frangible link means within the housing, plunger means engageable with the frangible link means, thermally responsive disc means changeable in physical shape in response to a temperature change to move the plunger means to break the frangible link means to interrupt the electric circuit means, the housing being substantially tubular and of electrically conducted material, the housing having a first end portion and a second end portion, a first electric conductor attached to the first end portion of the housing, a second electric conductor, electric insulator means attaching the second electric conductor to the second end portion of the housing, a connector member of electrical conductive material within the housing and electrically connecting the housing to the second electric conductor, the connector member having a frangible link portion between the second conductor and the housing, a plunger within the housing and engageable with the frangible link portion of the connector member, a stack of thermally responsive discs within the housing and changeable in length in response to temperature change to engage the plunger, the stack of discs applying a force upon the plunger as the stack of discs changes in length, the stack of discs thus moving the plunger and breaking the frangible link and interrupting the electric circuit between the second electric conductor and the housing.

5. An electric circuit interrupter device comprising:

a housing, electric circuit means extending through the housing, the electric circuit means including frangible link means within the housing, plunger means engageable with the frangible link means, thermally responsive disc means changeable in physical shape in response to a temperature change to move the plunger means to break the frangible link means to interrupt the electric circuit means, the housing being of electrically conductive material, the housing having a pair of opposed portions, a first electric conductor attached to one portion of the housing, a second electric conductor, electrical insulator means joining the second electric conductor to the other portion of the housing, an electric connector member, means electrically connecting the second electric conductor to the connector member and means electrically connecting the connector member to the housing, the connector member being provided with a frangible link between the second conductor and the housing, a plunger within the housing and engageable with the frangible link, a bimetallic disc within the housing and changeable in physical shape to move the plunger to break the link and to interrupt the electric circuit between the second conductor and the housing.

6. An electric circuit interrupter device comprising:

electric circuit means including frangible link means, the frangible link means being breakable to interrupt the electric circuit means, thruster means movable with respect to the frangible link means to break the frangible link means, and thermally responsive disc means changeable in physical shape to move the thruster means to break the frangible link means to interrupt the electric circuit means, the electric circuit means including an electrically conductive housing member, a pair of electric conductor members, there being a first electric conductor member and a second electric conductor member, electric conductor means electrically connecting the first electric conductor member to the housing member, electric insulator means connecting the second electric conductor member to the housing, electric connector means connecting the second electric conductor member to the housing, the electric connector member including a frangible link between the second electric conductor member and the housing.

* * * * *